US005290025A

United States Patent [19]

Plent et al.

[11] Patent Number: 5,290,025

[45] Date of Patent: Mar. 1, 1994

[54] DEVICE FOR DISCHARGING AND STACKING FLAT OBJECTS ON EDGE, ESPECIALLY PIECES OF MAIL AT THE OUTPUT OF A SORTING MACHINE

[75] Inventors: Christian Plent, Bourg les Valence; Bernard Constant, Beaumont les Valence; Michel Divoux, Chateauneuf Sur Isere; Jacky Gregoire, Valence, all of France

[73] Assignee: Compagnie Generale D'Automatisme CGA-HBS, Bretigny Sur Orge, France

[21] Appl. No.: 915,670

[22] Filed: Jul. 21, 1992

[30] Foreign Application Priority Data

Jul. 22, 1991 [FR] France ..... 91 09234

[51] Int. Cl.[5] ..... B65H 29/44

[52] U.S. Cl. ..... 271/181; 271/306; 271/177

[58] Field of Search ..... 271/306, 177, 180, 181, 271/207, 189, 213

[56] References Cited

U.S. PATENT DOCUMENTS

| | | | |
|---|---|---|---|
| 3,633,479 | 1/1972 | Bergstrom | 271/181 |
| 3,724,640 | 4/1973 | Rapparlie | 271/213 X |
| 3,847,388 | 11/1974 | Lynch | 271/306 |
| 3,975,010 | 8/1976 | Schisselbauer et al. | 271/180 X |
| 4,436,301 | 3/1984 | Doery et al. | 271/177 |
| 4,441,702 | 4/1984 | Nagel et al. | 271/177 |
| 4,824,091 | 4/1989 | Knight | 271/207 X |

FOREIGN PATENT DOCUMENTS

| | | | |
|---|---|---|---|
| 0049718 | 4/1982 | European Pat. Off. . | |
| 0159061 | 10/1985 | European Pat. Off. . | |
| 0231961 | 8/1987 | European Pat. Off. | 271/177 |
| 548463 | 3/1932 | Fed. Rep. of Germany | 271/87 |
| 2387892 | 11/1978 | France . | |
| 0011463 | 1/1983 | Japan | 271/207 |
| 0026758 | 2/1983 | Japan | 271/213 |
| 0258360 | 10/1988 | Japan | 271/279 |
| 0267624 | 11/1988 | Japan | 271/207 |
| 01-38070 | 5/1990 | Japan | 271/181 |
| 01-38073 | 5/1990 | Japan | 271/181 |
| 0607770 | 3/1978 | U.S.S.R. | 271/181 |
| 1177267 | 1/1970 | United Kingdom | 271/177 |

OTHER PUBLICATIONS

Doolittle et al, Stacker-Reader Sorter, Mar. 1971, pp. 3109-3110, IBM Technical Disclosure Bulletin vol. 13 No. 10.

Patent Abstracts of Japan, vol. 7, No. 85 (M-206)(1230) Apr. 9, 1983 & JP-A-58 011 463 (Fuji Xerox K.K.) Jan. 22, 1983.

Patent Abstracts of Japan, vol. 9, No. 55 (M-362)(1778) Mar. 9, 1985 & JP-A-59 190 160 (Hitachi Seisakusho K.K.) Oct. 27, 1984.

*Primary Examiner*—H. Grant Skaggs
*Assistant Examiner*—Carol Lynn Druzbick
*Attorney, Agent, or Firm*—Sughrue, Mion, Zinn, Macpeak & Seas

[57] ABSTRACT

A device for discharging flat objects into a receptacle, especially pieces of mail or letters at the output of a sorting machine in which the letters are routed vertically disposed in pockets and are released above the said device, wherein the device comprises:

a flat main guide surface inclined at an angle relative to the vertical plane and down which the flat object at the output of the pocket falls under gravity, a deflecting and retaining plate downstream of the main surface, and a receptacle inclined at an angle relative to the horizontal plane, the plate being movable from an initial position in which its lower edge is parallel to and close to the base of the lowermost wall of the receptacle, to an end position in which it is near to the uppermost wall of the receptacle.

10 Claims, 2 Drawing Sheets

A
B
P
α
β
δ

DEVICE FOR DISCHARGING AND STACKING FLAT OBJECTS ON EDGE, ESPECIALLY PIECES OF MAIL AT THE OUTPUT OF A SORTING MACHINE

The present invention relates to a device for discharging flat objects into a receptacle, especially pieces of mail or letters at the output of a sorting machine in which the letters are routed vertically disposed in pockets and are released above the said device.

BACKGROUND OF THE INVENTION

More particularly, in such a sorting machine, each letter, whose destination has previously been ascertained, is disposed vertically in a pocket. The pockets are routed by a carousel and their bottoms are opened above the appropriate output station to release each letter. At this output station, the letters are stacked flat or are stacked on edge in a movable tray or in a fixed box.

Generally speaking letters are stacked flat in trays such that these output stations are particularly bulky. The trays at the output station have to have dimensions matching the largest size of letters which are handled.

By virtue of the invention, letters are stacked on edge. There is thus a significant saving of space, and for example two box output stations can take the place of one tray output station. Moreover, only the maximum length of letters which are handled has to be taken into account in determining the size of the receptacle receiving sorted letters.

The discharge device should thus receive a letter vertically and so guide it that it reaches the receptacle on its edge, where the letters should be stacked satisfactorily. The guiding should be effected correctly regardless of the rigidity of the letter, which may be a relatively flexible ordinary letter or a relatively rigid brochure, and regardless of the material of the wrapping of the letter, which may be of various kinds, in particular paper or a plastics film.

SUMMARY OF THE INVENTION

The present invention overcomes these problems and, to this end, the device comprises:

a flat main guide surface inclined relative to the vertical plane and down which the flat object at the output of the pocket falls under gravity, a deflecting and retaining plate downstream of the main surface, and a receptacle inclined relative to the horizontal plane, the plate being movable from an initial position in which its lower edge is parallel to and close to the base of the lowermost wall of the receptacle, to an end position in which it is near to the uppermost wall of the receptacle.

The properties required to discharge and stack on edge in the receptacle are thus obtained. The main guide surface deflects the letter from its initially vertical position into an inclined position and the plate ensures that the letter is braked and stabilized in a first interval of time. In a second interval of time, it is deflected parallel to the wall of the receptacle and the letter assumes its position parallel to the wall against which letters have possibly already been stacked and the plate retains it in this position. It is hinged to allow it to shift in the course of formation of the vertical stack of letters.

The initial position of the plate is preferably slightly inclined relative to the vertical plane in which the flat object falls at the output of the pocket.

In order to improve the guiding of the letter, the device may comprise a secondary surface substantially parallel to the main surface and forming therewith a through slot for the flat object and the main surface may be formed simply by a static slide surface with a low coefficient of friction, or else the main surface and also the secondary surface may be equipped with a conveyor belt.

When the receptacle is a box, namely a box fixed relative to the machine, the plate is hinged at its upper edge about a horizontal pivotal axis. This design is advantageous when the number of sorted letters for the destination is relatively small. Thus the fact that the box will not be filled in no way interferes with removal of letters from the box. This kind of receptacle also allows space to be saved and in general, at least two boxes can take the place of a single removable tray.

In the case of trays, i.e. larger, removable receptacles in which the letters can be transported for subsequent processing, the movement of the plate alone is not sufficient. In this case the main surface and the plate are fixed in an assembly hinged about a horizontal pivotal axis.

This assembly is preferably pivoted step by step by means of a motor.

When the main guide surface is equipped with a conveyor belt, the horizontal pivotal axis is preferably the upper entrainment axis of the conveyor belt of the main surface.

In order to allow removal of the full tray by means of a special device, the plate is upwardly retractable.

In accordance with a particular feature, the plate has a lower edge shaped to ensure intersection with the bottom of the cooperating receptacle.

BRIEF DESCRIPTION OF THE DRAWINGS

An embodiment of the invention is described by way of example with reference to the accompanying drawings, in which.

DETAILED DESCRIPTION

Figures 1, 3:
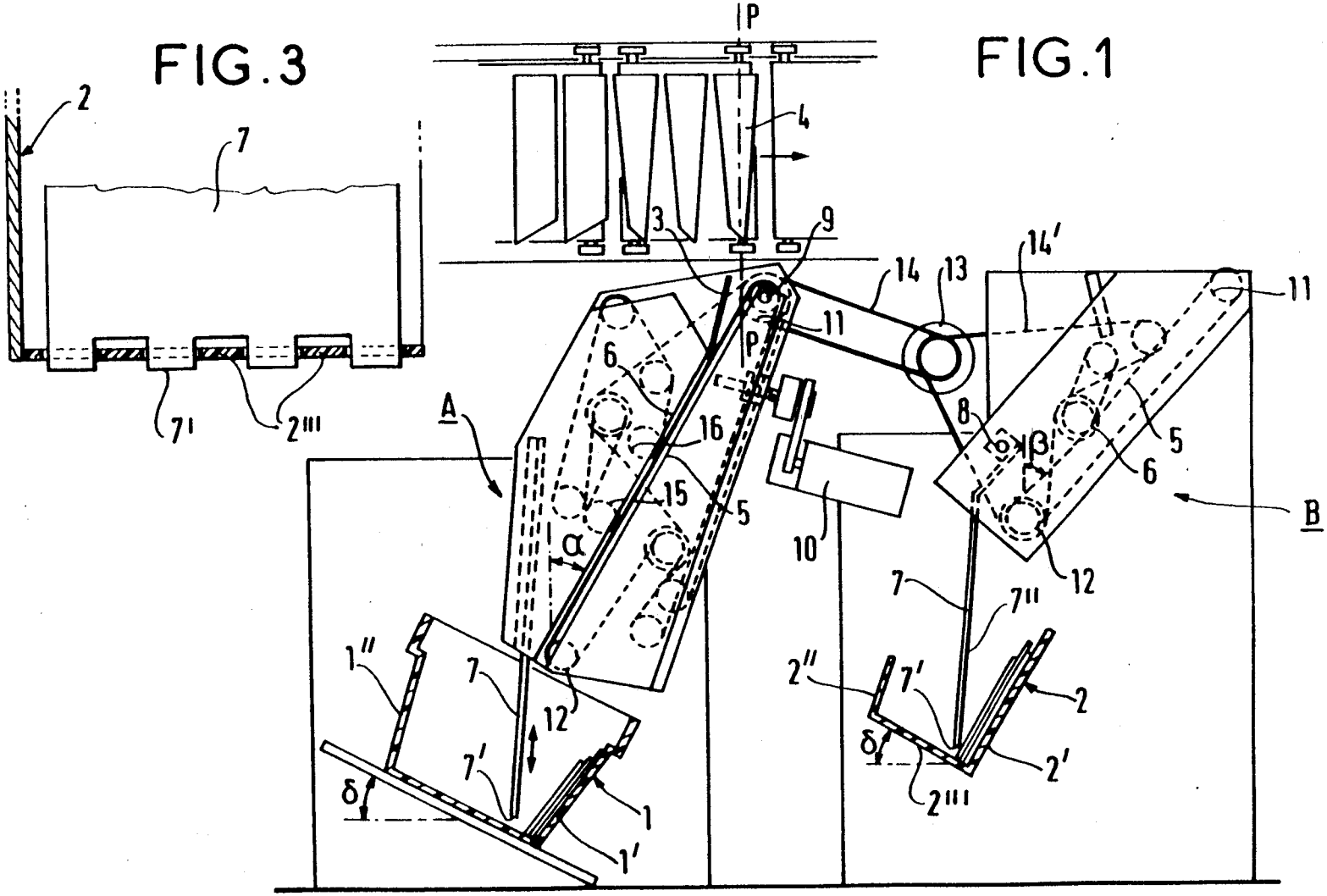
FIG. 1 is a front view of two variants of the device of the invention, fitted to a sorting machine.
FIG. 3 is a vertical section view of a variant of the fixed box of FIG. 1.

In FIG. 1, two devices are shown, one corresponding to a first variant A in which the receptacle is a removable tray 1 and the other to a second variant B in which the receptacle is a fixed box 2. The elements common to these two variants have identical references.

The letters are routed in pockets 4 moving on rails along a carousel. On opening the retractable bottom of the pocket 4, the letter falls vertically, under gravity, along the plane P—P.

The first variant A is now described.

It comprises a flat main guide surface or ramp 5 inclined at an angle $\alpha$ substantially equal to 30° relative to the plane P—P. This surface 5 is equipped with a conveyor belt entrained round rollers 11, 12, the upper roller 11 being rotated by a motor 13 through an endless belt 14.

A secondary surface 6 is disposed parallel to the main surface 5 and is also equipped with a conveyor belt entrained round rollers 15, 16 and rotated by the same motor 13 by means of an arrangement of belts and return pulleys. The letter is thus nipped between the two surfaces 5 and 6.

Downstream of the guideway thus formed there is located a deflecting and retaining plate or ramp 7. This plate 7 is slightly inclined relative to the plane P—P, for example by 5°. The plate 7 can be retracted by translation upwardly by means of a conventional motorized arrangement of toothed belts and pulleys.

The tray 1 is placed on a base inclined at an angle δ equal to 30° for example relative to the horizontal plane. The letters are stacked on edge parallel to the wall 1' of the tray 1.

The assembly comprising the main and secondary surfaces 5 and 6, the plate 7 and the associated drive means is fixed in a rigid structure which is formed essentially by front and rear walls and is pivotally movable about a hinge axis 9, which is preferably the axis of the upper roller 11 of the conveyor belt of the main surface 5. The pivoting is effected step by step by means of a motor 10 through known means, for example a nut and screw.

The assembly is thus shifted as the pile of letters grows in the tray 1. The extreme positions are detected by mechanical limit sensors 17 and 18 (FIG. 2), allowing the device to be stopped when the tray is full and interrupting the discharge of letters. The sensors are fixed on the frame of the sorting machine and cooperate with a fixed part on the device A.

A sensor 19 (FIG. 2) is located on the left face of the plate 7 to detect the absence of free space between the plate 7 and the stack of letters and controls the step by step movement of the assembly so as to re-create a free space allowing following letters to enter.

The mode of operation is described in more detail below.

The second variant B of simpler construction is intended for stacking on edge in a fixed box 2 of smaller size.

The main surface or ramp 5, inclined at an angle β of around 40° relative to the plane P—P is equipped with a conveyor belt entrained round the rollers 11 and 12 and rotated by the motor 13 through a belt 14'. The latter also operates a conveyor belt fitted to the secondary surface 6 which is restricted in this case to the line of contact of the second belt with the first, where the letter is nipped and entrained.

A plate or ramp 7 is located downstream of the main surface 5 and is freely hinged at its upper edge about a horizontal axis 8 fixed on the support structure which also carries the conveyor belts.

The box 2 is fixed to the sorting machine, inclined at an angle δ of around 30° relative to the horizontal plane.

The vertical letter released by the pocket 4 is thus driven along the main surface 5 and then comes into abutment with the plate 7, where it is deflected so as to be stacked on edge in the box on the letters possibly already stacked therein.

The plate 7, which may be biased by a return spring, shifts during the formation of the vertical stack by virtue of the pressure of the stacked letters against its face 7''. In the course of this shifting, the plate 7 comes into contact with a sensor which detects that the box 2 is full and stops the arrival of letters in this box until it is emptied by the operator.

Figure 2:
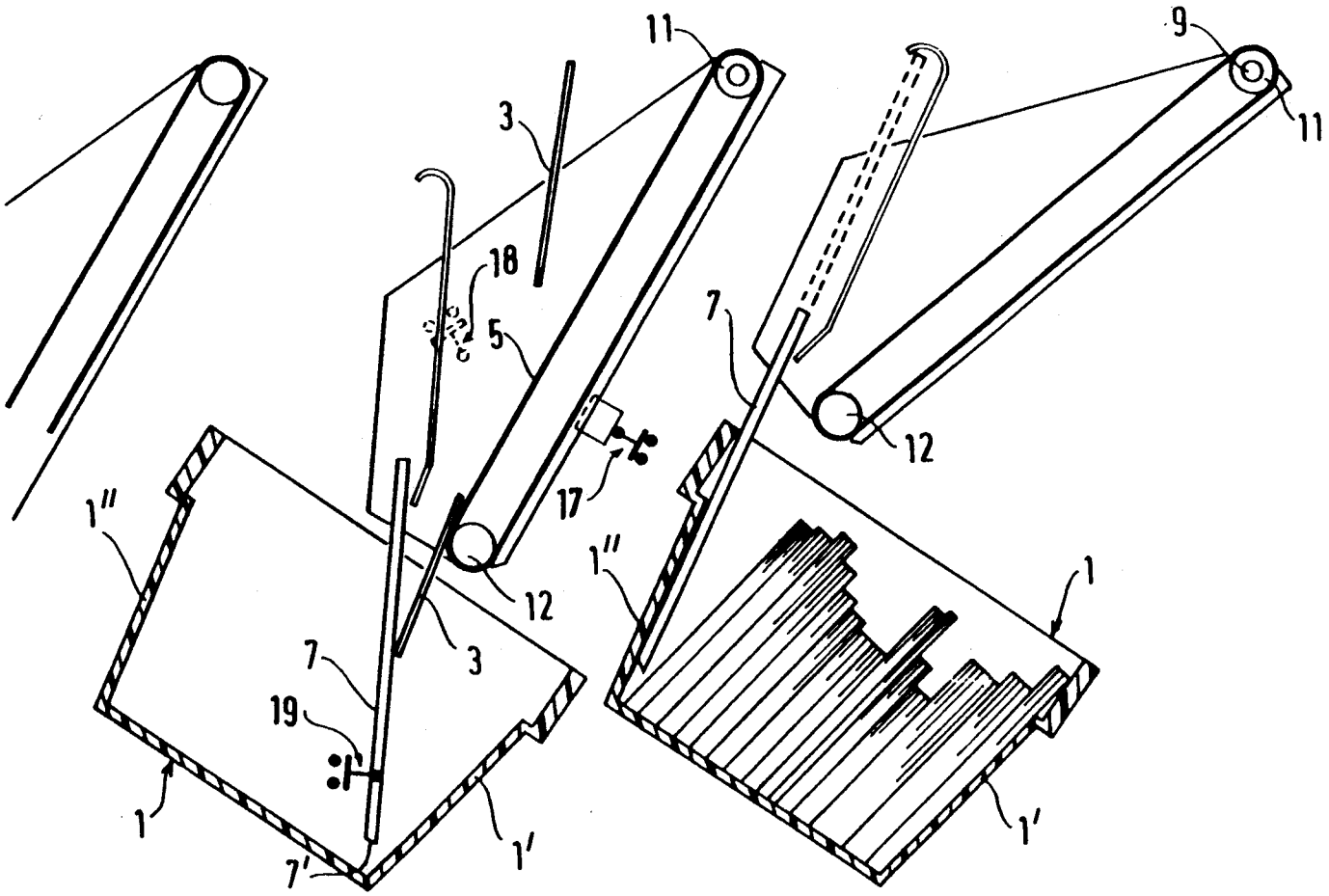
FIG. 2 is a front view of devices of the invention, one being in an initial stacking position and the other in an end position.

FIG. 2 is a schematic view showing the essential parts of the first variant A of the device of the invention. In this Figure, the device on the left is in the initial filling position, the tray being empty, and the device on the right is in the end position in which the tray is full.

In the initial position, the plate 7 has its lower edge 7' parallel to and near to the base of the lowermost wall 1' of the tray 1 and, in the end position, the plate 7 is near to the uppermost wall 1'' of the tray, or even in abutment therewith.

Moreover, the lower edge 7' of the plate may have a shape which ensures its intersection with the bottom of the tray 1 or of the box 2. In the case of the box 2 (FIG. 3), the bottom has slots in which teeth of the comb fit. The same design may be used in the case of the tray 1, but its bottom preferably has ribs between which the teeth of the comb fit so that the tray 1 keeps a closed bottom.

It is possible to form the device without a secondary surface, the main surface 5 alone ensuring guidance of the letter 3 towards the plate, where it is braked, stabilized and deflected.

It is also possible to form the device in either variant A or B with a static main surface 5 with a low coefficient of friction.

We claim:

1. A device for discharging and stacking flat objects into a receptacle, especially pieces of mail or letters at an output of a sorting machine, said device comprising routing means for routing each said flat object to a passage with said flat object disposed substantially vertically on edge for movement through said passage, and guiding means disposed under said passage and above said receptacle for guiding each flat object from the passage to the receptacle and for stacking each flat object on edge on a bottom of said receptacle in order to form a stack of said flat objects on edge in the receptacle, and wherein said guiding means comprise:

a first ramp disposed under the passage and having an upwards facing first guiding surface on which each of said flat objects is moved from said passage to a lower end of said first ramp; and a second ramp disposed between said first ramp and said receptacle and having a downwards facing second guiding surface on which said flat object is moved to said receptacle after leaving a lower end of said first ramp, said first and second guiding surfaces being engageable with opposite sides of said flat object and defining further a space between said first and second ramps in which said each said flat object is deviated.

2. The device according to claim 1, wherein said first ramp is rotatably mounted about an axis at an upper end thereof and said device further includes means for pivoting said first ramp step by step by means of a motor.

3. The device according to claim 2, wherein said second ramp is retractably mounted relative to said first ramp for translation of said second ramp upwardly away from said receptacle bottom.

4. The device according to claim 1, wherein said second ramp is retractably mounted relative to said first ramp for translation of said second ramp upwardly away from said receptacle bottom.

5. The device according to claim 1, wherein said first ramp is inclined about 30° relative to a vertical plane and said second ramp is slightly inclined about 5° relative to said vertical plane.

6. The device according to claim 5, wherein said first ramp comprises a conveyor belt.

7. The device according to claim 6, wherein said second ramp is a deflecting plate.

8. The device according to claim 7, wherein said deflecting plate has a lower edge with teeth intersecting respectively, slots within the bottom of the receptacle.

9. The device according to claim 5, wherein said first ramp is a plate having a static slide surface with a low coefficient of friction.

10. The device according to claim 9, wherein said second ramp is a deflecting plate.

* * * * *